United States Patent [19]

Jeffery

[11] Patent Number: 5,031,257

[45] Date of Patent: Jul. 16, 1991

[54] CONVERTIBLE SHOWER ENLARGER

[76] Inventor: Robert W. Jeffery, 32555 Susanne, Franklin, Mich. 48025

[21] Appl. No.: 431,766

[22] Filed: Nov. 6, 1989

[51] Int. Cl.[5] ..... A47K 3/22

[52] U.S. Cl. ..... 4/610; 4/559; 4/605; 4/607; 4/608; 160/330; 16/94 D

[58] Field of Search ..... 4/558, 610, 608, 597, 4/609, 612, 613, 607, 614; 248/251, 291; 211/105.2, 95, 115

[56] References Cited

U.S. PATENT DOCUMENTS

| | | | |
|---|---|---|---|
| 1,299,556 | 4/1919 | Crecelius | 248/264 |
| 2,573,985 | 11/1951 | Porter | 4/610 |
| 2,774,974 | 12/1956 | Zaloga | 4/610 |
| 2,778,030 | 1/1957 | Goche | 4/608 |
| 2,796,227 | 6/1957 | Coakley | 4/610 |
| 3,872,520 | 3/1975 | Tyconik | 4/610 |
| 4,229,842 | 10/1980 | Gilmore | 4/558 X |
| 4,653,714 | 3/1987 | Andrasko, Jr. | 248/251 |
| 4,700,918 | 10/1987 | Andrasko, Jr. | 248/251 |
| 4,754,504 | 7/1988 | Cellini | 4/558 |

*Primary Examiner*—Henry K. Artis
*Attorney, Agent, or Firm*—Lynn E. Cargill

[57] ABSTRACT

Disclosed is a shower enlarger assembly including a mounting bracket for engaging to a wall the ends of a bent shower curtain rod having an offset medial section for providing a greater stall space and for holding a shower curtain out of body contact. The mounting bracket includes a supporting backplate for contact with the wall and a recessed area located midsection of the supporting backplate for receiving the end of the bent shower curtain rod. The bent shower curtain rod is slidably inserted and rotatably mounted within the recessed area of the backplate. The bent shower curtain rod has attached thereto an integral rotating stop member extending outwardly from the curtain rod. A substantially semicircular fixed stop member extends outwardly from the face of the backplate and receives the integral rotating stop member attached to the bent shower curtain rod. The showering area of a shower stall may be enlarged by rotating the bent shower curtain rod to an outwardly extending first position, which places the top of a shower curtain hanging therefrom in a position outside the showering area. In a second, bathroom area increasing position, the shower curtain rod hangs in a recessed fashion within the shower stall such that the shower curtain hangs freely so that mold and mildew does not form on the shower curtain and the bathroom space is effectively increased. Also contemplated is a shower enlarger assembly which includes a straight shower rod capable of being reciprocated in a track between a showering area enlarging and a bathroom area enlarging position.

3 Claims, 3 Drawing Sheets

62
64
66
68
69

72
76
78
74
79

8C
82
84
89
86
88

9C
92
96
99
94
98

CONVERTIBLE SHOWER ENLARGER

TECHNICAL FIELD

This invention relates to shower enlargement assemblies, and more particularly to a shower enlarger assembly which may be switched from a first, shower area increasing position to a second, bathroom increasing position.

BACKGROUND OF THE INVENTION

It is well known that common shower installations may consist of a bathtub with a shower curtain in a three walled shower enclosure. An enclosure around a portion of the installation may include a moveable curtain closure along the remaining portion or portions of the installation. The movable curtain closure may be a shower curtain which does not provide ample room for the person showering. There have been several disclosed attempts to provide enlarged shower areas, such as a modified shower curtain rod having an offset medial section for guiding the shower curtain which hangs therefrom out into the bathroom area, generally giving more shoulder room. In the case of large men or women showering, more room is needed for comfortable showering.

The abovementioned prior art device has a disadvantage in that the offset medial section curtain rod permanently displaces the shower curtain outwardly from the bathtub area, thereby permanently enlarging the shower area into the bathroom area and causing the shower curtain to hang against the inside of the bathtub instead of hanging freely. This creates a problem, because when the shower curtain is in this position, it cannot properly dry, thereby accelerating the grow of bacteria, mold, and fungus on the curtain and drastically decreasing the service life of the shower curtain, and it reduces the usable space in the bathroom area both literally and psychologically.

Other attempts have been made to enlarge the shower area which include a type of enlarging attachment to be secured to or on a standard linear shower curtain rod. These attachments require modifications to the standard curtain rod which may involve drilling and attaching or otherwise mechanically mounting the attachment to the standard shower curtain rod. One such attachment acts to bow out the curtain itself to enlarge the shower area. Such an attachment must be put into place after the person climbs into the shower area and is longer than the standard curtain rod. It is mounted by abutting the ends between opposing walls of the shower enclosure. The size of the attachment may make proper placement difficult and awkward for some people. The following patents describe these and other prior art means for enlarging a shower area.

U.S. Pat. No. 4,754,504 issued July 5, 1988 to Cellini discloses a shower stall structure for bathing having a shower area defined on three sides by upright walls and an open area with a shower curtain mounted therein to provide a covered point of entry for a person. A shower enlarger is mounted in the shower area. The shower enlarger comprises a one-piece curtain rod having an offset medial section engageable with an upper area of the shower curtain for providing greater stall space for upper body movement while showering. The offset medial section includes a pair of angular curtain rod sections which extend in a diverging relation away from opposite ends of the offset medial section. The angular curtain rod sections are attached to its end sections at the outer ends. The outer ends of the end sections extend in opposite directions away from one another. A fastening structure is provided for securing the outer ends of the end sections to the walls of the shower area. The end sections are positioned in relation to the midsection so as to extend generally in the same direction.

U.S. Pat. No. 3,418,665 issued on Dec. 31, 1968 to Long discloses a shower space extending installation comprising a space-extending, generally U-shaped curtain rod which includes an elongated portion and legs which extend substantially at right angles thereto. Attachment means are carried by each of the legs in proximity to the elongated portion, and friction bumpers are mounted at the end of each leg. The space extending rod may be connected to a normal shower curtain rod by the attachment means so that the ends of the legs push against the opposite shower stall wall and the elongated portion projects laterally outwardly of the usual curtain rod and shower space.

U.S. Pat. No. 3,872,520 issued on Mar. 25, 1975 to Tyconik discloses a shower curtain supporting member comprising an inverted U-shaped mounting member intended to be disposed over an existing shower curtain rail between an appropriate pair of curtain rings. Four arms are pivotally mounted on one leg of the mounting member for movement between an open position and a closed position in which they hang downwardly generally alongside each other and in which they can be concealed behind the shower curtain when not in use. Aligned openings are provided in the mounting member and the curtain rail to receive a pin which in turn hold the arms angularly outwardly relative to and against the curtain. The arms can then be pivoted into an open fan-like orientation to prevent blowing of the curtain against a person taking a shower. The curtain also serves to hold the arms in the fan-like orientation.

U.S. Pat. No. 4,229,842 issued Oct. 28, 1980 to Fillmore discloses a shower curtain adapter for expanding the showering space within a shower enclosure. The enclosure has first and second vertical sidewalls, a third wall which extends between the first and second sidewalls and a shower curtain which hangs a linear standard curtain rod between the first and second walls. The adapter includes an adapter rod having a length which is greater than the distance between the first and second walls and which is made of a flexible material. The adapter rod may be mounted in an operative fashion between the first and second walls to flex into a bow configuration for engaging the hanging shower curtain and pushing it outward of the enclosure to expand the showering space. A coupling means for supporting the adapter rod from the standard curtain rod is pivotally coupled at one end thereof to the adapter rod and has means at the other end for coupling to the standard curtain rod to prevent downward movement of the adapter rod when mounted in its operative position. When in its storage position, the adapter rod hangs by the coupling means from the curtain rod and may be concealed behind the shower curtain.

Accordingly, it would be advantageous to provide a shower enlarger assembly that temporarily increases the showering area while temporarily reducing the area available in the rest of the bathroom only when a person is showering. When showering is finished, the shower enlarger assembly would be most advantageous if it would retract the shower enlarger to restore the original area of the bathroom and allow the shower curtain to hang freely within the shower area to dry properly, thereby substantially preventing the growth of mold and mildew.

It is therefore an object of the present invention to provide a shower enlarger assembly which temporarily increases the showering area when a person is showering, does not reduce the area in the rest of the bathroom when the shower is complete, and allows the shower curtain to hang freely and dry so that the growth of mold is inhibited.

SUMMARY OF THE INVENTION

In accordance with the present invention, there is provided a shower enlarger assembly for providing a temporarily increased shower area. In a first embodiment, the shower enlarger includes two mounting brackets for pivotally mounting and freely rotating a bent shower curtain rod within a shower area. Each mounting bracket includes a backplate for attaching to a wall. The backplate has a recessed area for receiving the ends of the bent shower curtain rod which slide into the recessed area and rotate therein to freely position the bent shower curtain rod between a first, shower enlarging position and a second, bathroom enlarging position. In at least one of the mounting brackets, a fixed stop member is positioned adjacent to the recessed area which may be semicircular, and may extend outwardly from the backplate. The bent shower curtain rod may have a rectangular, U-shaped or arched midsection. At least one end of the bent shower curtain rod has an integral rotating stop member which may be a pin or the like so that when the bent shower curtain rod is rotated, the pin or the like prevents further travel as it contacts the fixed stop member. When the bent shower curtain rod is in one position, the offset or arched midsection faces away from the shower area, thereby temporarily enlarging the shower area. When the bent shower curtain rod is in the other position, the offset or arched midsection faces inwardly towards the shower area thereby enlarging the bathroom area and allowing the shower curtain to hang freely to dry completely without mold and mildew forming on the curtain.

Further in accordance with the present invention, the shower enlarger may be a combination of: (1) a supporting backplate attached to a wall by any normal mounting means having a recessed area for receiving the ends of a bent shower curtain rod, (2) a bent shower curtain rod having an offset medial section with at least one integral rotating stop member, which extends from the bent shower curtain rod, and (3) a fixed stop member attached to the backplate shaped and positioned in a manner as to restrict the rotation of bent shower curtain rod when inserted in the recessed area of the supporting backplate. The fixed stop members interact with the rotating stop members by restricting the rotation of the bent shower curtain rod to a first position so that the offset medial section of the shower curtain rod is facing away from the shower area or to a second position so that the offset medial section of the bent shower curtain rod is facing in towards the shower area, resulting in a reduced shower area.

Another embodiment of the present invention discloses a mounting bracket to be used with a standard linear shower curtain rod that attaches to a wall. The mounting bracket includes an elongated backplate having an elongated slot for receiving the ends of the linear shower curtain rod. The rod may travel within the slot from a first position which enlarges the shower area to a second position which enlarges the bathroom area. There are depressions at both ends of the elongated slot, for cradling the shower curtain rod to hold it firmly in either position.

The shower enlarger assemblies described above may be made of any corrosion resistant material, but are preferably made of a material such as a stainless steel or plastic or any other suitable material.

DETAILED DESCRIPTION OF THE INVENTION

Figure 1:
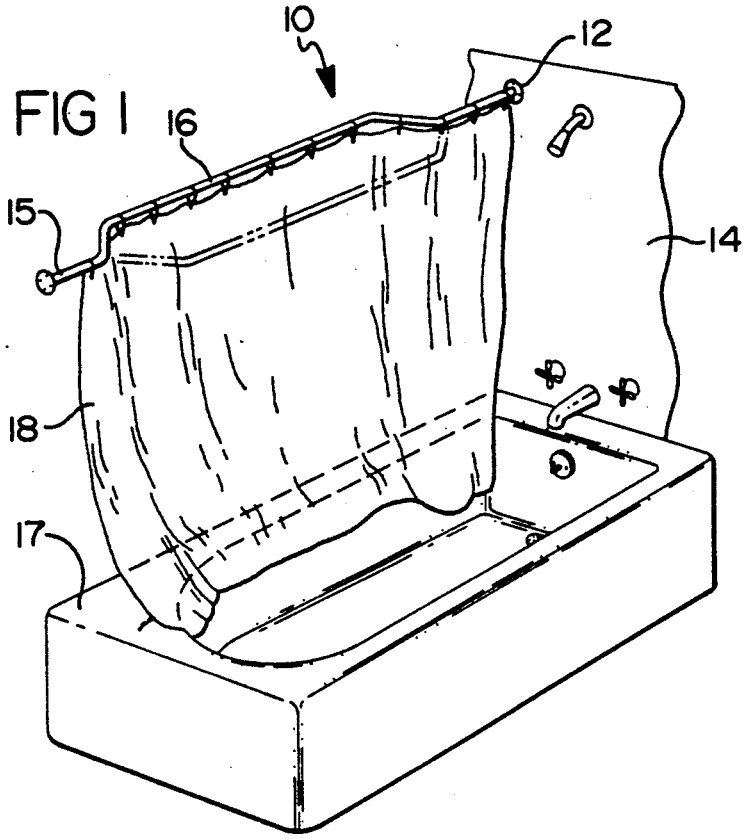
FIG. 1 is a perspective view of a shower installation with a shower enlarger assembly shown attached to one wall of a shower enclosure.

Turning first to FIG. 1, a perspective view of a showering area is shown. The shower enlarger assembly, generally denoted by the numeral 10, consists of a mounting bracket 12 attached to a shower wall 14, and a bent shower curtain rod 15 having an offset medial section 16. A shower curtain 18 hangs from the bent shower curtain rod 15. When the bent shower curtain rod 15 is in a first outwardly extending position as shown, the offset medial section 16 holds the shower curtain 18 in a position which enlarges the showering area. In this position, the shower curtain 18 falls against the side of a bathtub 17. Thus, the showering area is enlarged above the bathtub 17 and the water is contained by the shower curtain 18 resting on the inside of the bathtub 17. When the shower is finished, the bent shower curtain rod 15 may be rotated inwardly to a second bathroom enlarging position as shown by the dashed lines to allow the shower curtain 18 to hang from the bent shower curtain rod 15 such that the shower curtain will not rest against the bathtub 17. Therefore, the curtain is more likely to hang freely and dry so the growth of bacteria and mold on the shower curtain 18 is discouraged.

Figure 2:
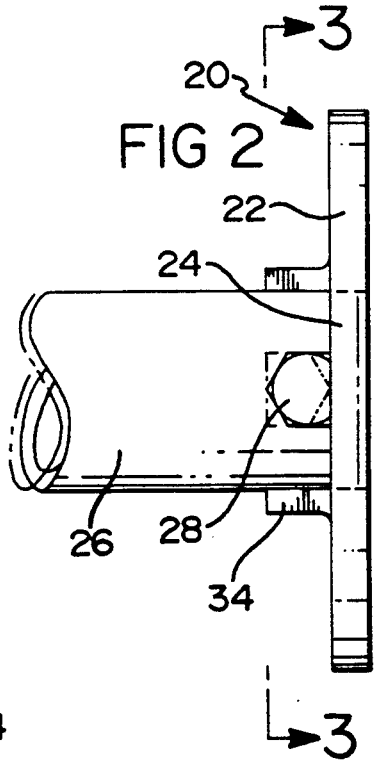
FIG. 2 is a side view of a shower enlarger assembly including a supporting backplate having a fixed stop member and an end of a bent shower curtain with an integral rotating stop member.

In looking now to FIG. 2, a side view of a shower enlarger assembly mounting bracket, generally denoted by the numeral 20, is shown. The mounting bracket 20 has a supporting backplate 22 which attaches to a shower wall 14. The supporting backplate has a recessed area 24 in its midsection that is able to receive an end of a bent shower curtain rod 26. The bent shower curtain rod 26 is slidably inserted and may be rotated within the recessed area 24 of the supporting backplate 22. Attached or integral to the supporting backplate 22 is a fixed stop member 34. Fixed stop member 34 is substantially semicircular and may be integral with the supporting backplate 22. Near the end of the bent shower curtain rod 26 is an integral rotating stop member 28. The integral rotating stop member 28 may rest against fixed stop member 34 as the bent shower curtain rod 26 is rotated within the recessed area 24 of the supporting backplate 22. By rotating the bent shower curtain rod 26, the showering area may be enlarged or decreased when the offset medial section of the bent rod is placed in either the first or second position as described hereinabove.

Figure 3:
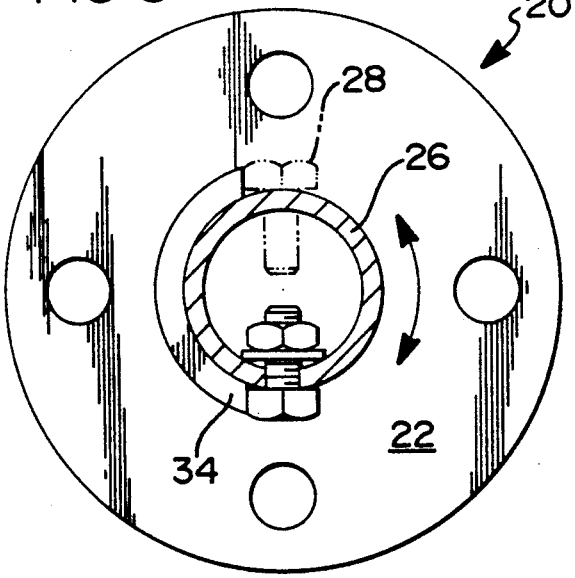
FIG. 3 is a front plan view of a supporting backplate of a shower enlarger assembly.

Referring now to FIG. 3, the front view of shower enlarger assembly mounting bracket 20 is shown. A cross sectional cut away view of bent shower curtain rod 26 is shown in place within a supporting backplate 22 of the mounting bracket 20. The bent shower curtain rod 26 has an attached integral rotating stop member 28. The integral rotating stop member 28 is shown as a nut and bolt assembly but may be any other operational rigid abutment assembly. The supporting backplate 22 has a semicircular stop 34 located adjacent to the bent shower curtain rod 26 when the rod is in place. The rotating stop member 28 is designed to rest against the edges of the semicircular fixed stop member 34, thereby holding the bent shower curtain rod 26 either in a first position which enlarges the showering area or in a second, shower area decreasing position which allows the shower curtain to hang freely and dry and also restores the area available in the rest of the bathroom.

Figure 4A:
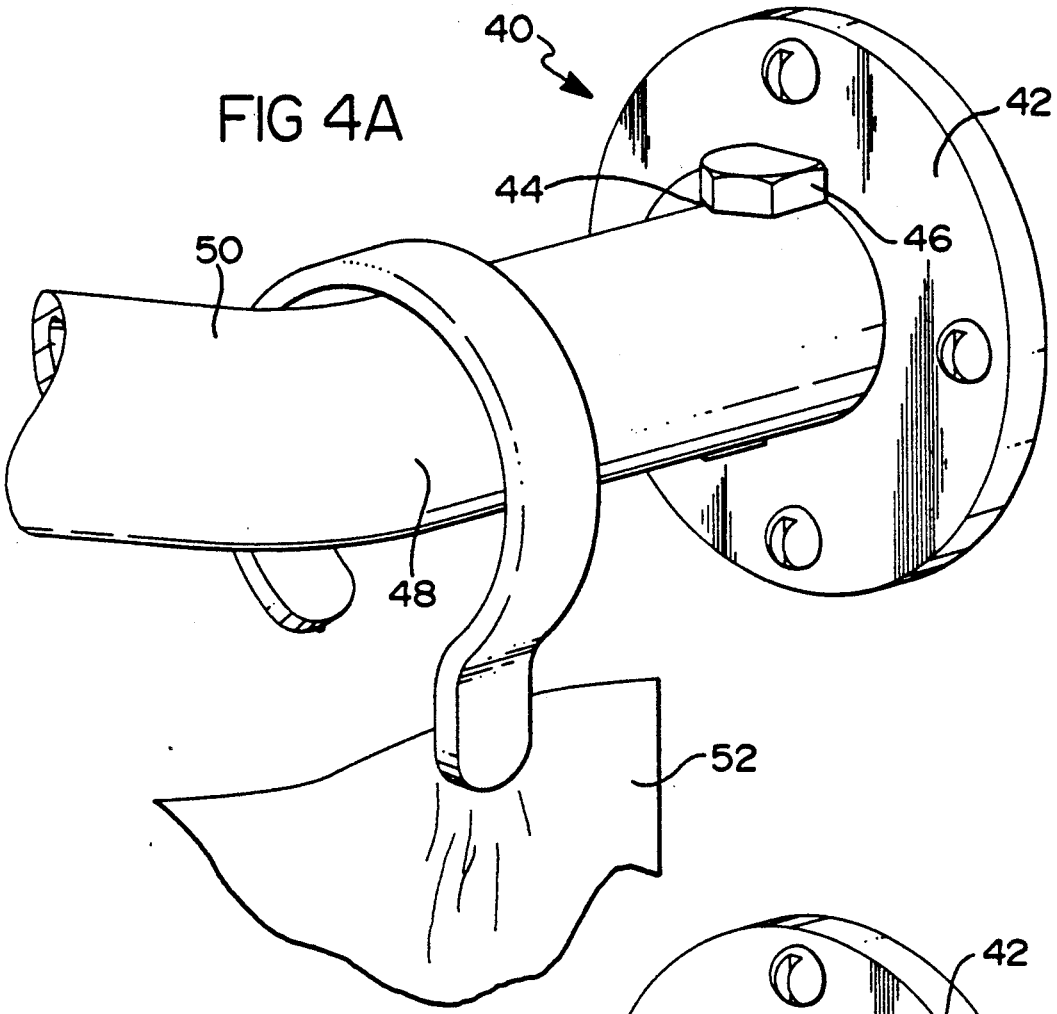
FIG. 4A is a perspective view of a shower enlarger assembly mounting bracket with a bent shower curtain rod in a first position for increasing the showering area.
Figure 4B:
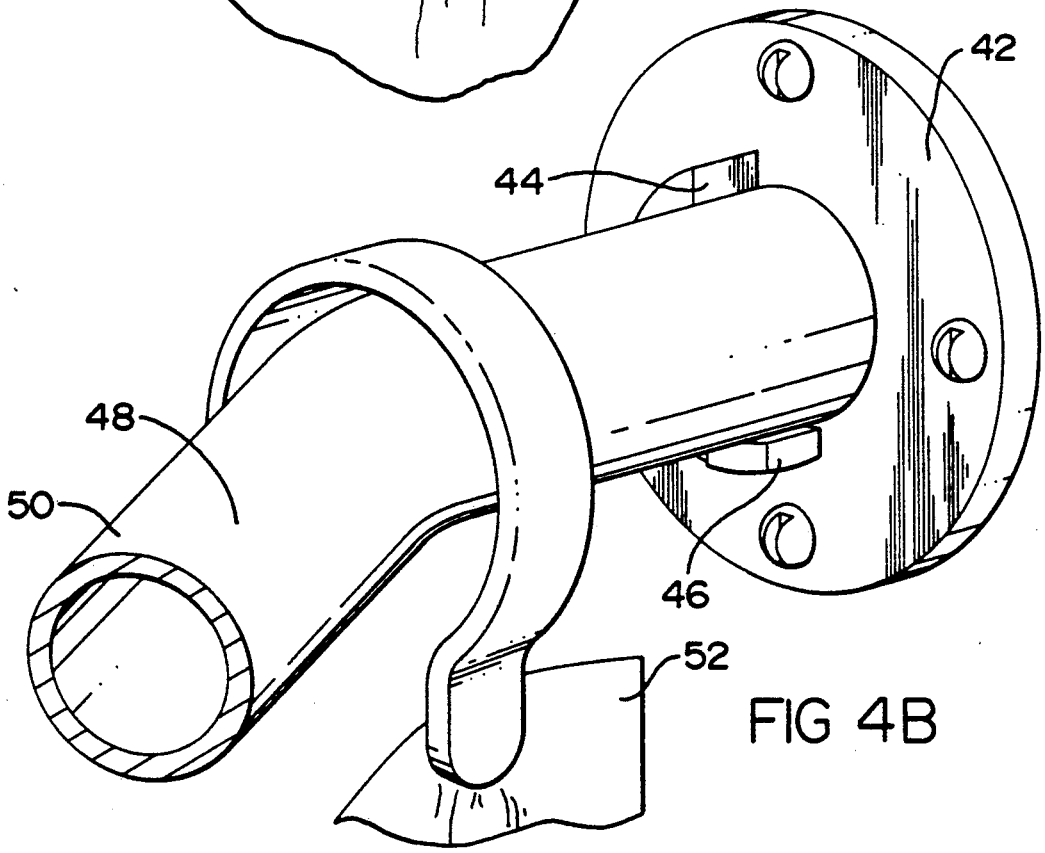
FIG. 4B is a perspective view of a shower enlarger assembly mounting bracket with a bent shower curtain rod in a section position for decreasing the showering area while increasing the area available in the rest of the bathroom.

Finally, FIGS. 4A and 4B show the first and second positions of the shower curtain rod 48 within the shower enlarger assembly mounting bracket as generally denoted by the numeral 40. The shower enlarger assembly mounting bracket 40 has a supporting backplate 42 and a fixed stop member 44 and a bent shower curtain rod 48 having an offset medial section 50 and a rotating stop support member 46.

In FIG. 4A, the bent shower curtain rod 48 has been rotated to a first position so that the offset medial section 50 extends outwardly away from the showering area thereby increasing the area available to a person taking a shower and also keeps the shower curtain 52 from coming into contact with the person. The bent shower curtain rod 48 is held in the first position by the rotating stop member 46 resting against the semicircular fixed stop member 44 of the supporting backplate 42. The weight of the offset rod and shower curtain 52 holds the bent shower curtain rod 48 in this first position.

After the shower is over, a person then rotates the bent shower curtain rod 48 to a second position as shown in FIG. 4B. In this second position, the rotating stop member 46 is now resting against the other edge of the fixed stop member 44. As shown, the offset medial section 50 now extends inwardly toward the showering area. In this second position, the shower curtain 52 hangs freely from the bent shower curtain rod 48 and does not rest against a bathtub edge so the shower curtain 52 is more apt to dry completely, thereby substantially preventing the growth of fungus, mold and bacteria on the shower curtain. Also in this second position, the area of the rest of the bathroom is increased in size.

In alternative designs for mounting a bent shower curtain rod as described above, the shower curtain rod could slideably attach to the mounting bracket by inserting a hollow end of the shower curtain rod onto a mating projection on the mounting bracket. In addition, variations in the designs of the stop members are possible. For example, stop members may be indentations into or protrusions from the mounting bracket or curtain rod, and may be axial, tangential, or radial.

Figures 6A, 6B, 6C, 7A, 7B, 7C, 8A, 8B, 8C, 9A, 9B, 9C:
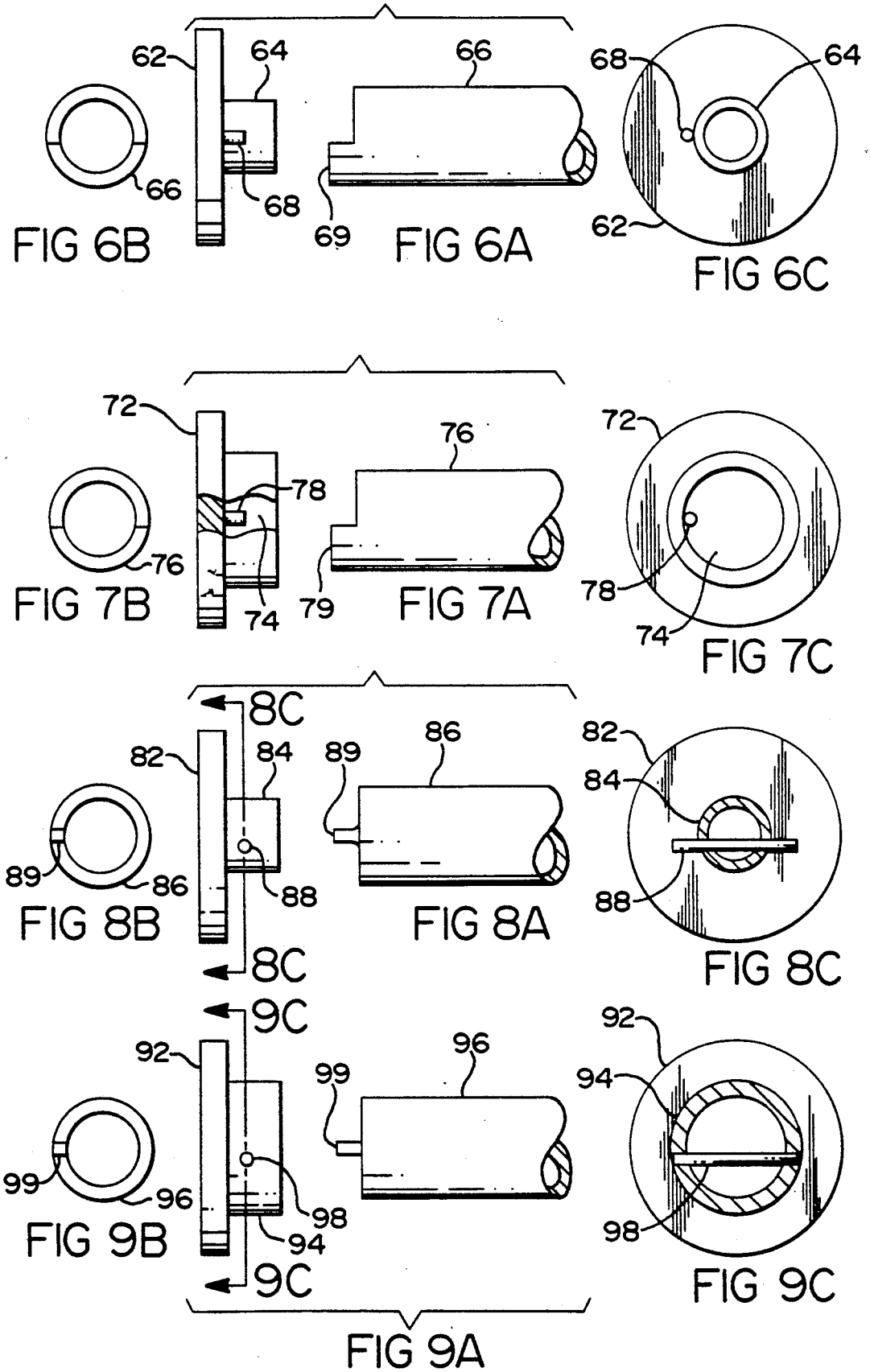

For illustration of the various designs, FIG. 6A shows mounting bracket 62 having a circular protrusion 64 for fitting inside the end of a hollow curtain rod 66. FIG. 6B shows an end view of hollow curtain rod 66. Circular protrusion 64 has a pin 68 alongside, as shown also in FIG. 6C which is the front view of mounting bracket 62. Curtain rod 66 has a semicircular protrusion 69 on its end. One position of the curtain rod-mounting bracket combination is as though curtain rod 66 and mounting bracket 62 were connected in the position as shown. A second position of curtain rod 66 is achieved when curtain rod 66 is rotated 180° so that the semicircular protrusion 69 is on top and one end of the semicircular protrusion 69 rests on pin 68. Alternatively, pin 68 could protrude outwardly extending radially from the side of circular protrusion 64.

FIG. 7A shows mounting bracket 72 having annular recess 74 and pin 78 inside and off to one side of annular recess 74. Curtain rod 76 is sized to fit slideably within recess 74 and has semicircular protrusion 79 on its end. FIG. 7C is a front view of mounting bracket 72 and FIG. 7B is a front view of curtain rod 76. Curtain rod 76 when inserted into recess 74 can rest as shown or may be rotated 180° to a second position so that an end of semicircular protrusion 79 hits against pin 78.

FIG. 8A shows a female curtain rod 86 which is placed over male annular protrusion 84 attached to mounting bracket 82. Annular protrusion 84 has an elongated pin 88 extending through its lower half so that elongated pin 88 projects from annular protrusion 84 in two places. Curtain rod 86 has projection 89 projecting outwardly toward mounting bracket 82. When curtain rod 86 is placed on annular protrusion 84, curtain rod 86 can rest in two positions, where projection 89 can rest on either end of elongated pin 88. FIG. 8C is the front view of mounting bracket 82, and FIG. 8B is the front view of the end of curtain rod 86.

Similar to the embodiment of FIG. 8A, FIG. 9A shows a male curtain rod 96 having projection 99 and mounting bracket 92 having female annular protrusion 94 attached thereto with pin 98 extending therethrough. FIG. 9C is the front view of mounting bracket 92, and FIG. 9B is the front view of the end curtain rod 96.

In yet another embodiment, a more generalized description of a shower enlarger assembly for enabling adjustment of a shower curtain rod from a first outward position to a second inward position is disclosed which includes a mounting bracket for engaging to a wall the end of a straight shower curtain rod. The mounting bracket includes a supporting backplate attached to a wall, an attachment means on the mounting bracket for slideably receiving the end of the shower curtain rod, and first and second stop member locations on the mounting bracket so that the shower curtain rod can be slideably moved from the first stop member location to the second stop member location. When the shower curtain rod is slid into the first stop member location, the shower curtain rod is moved inward toward the shower area and, when the shower curtain rod is slid into the second stop member location, the shower curtain rod is moved outward from the shower area.

Figure 5:
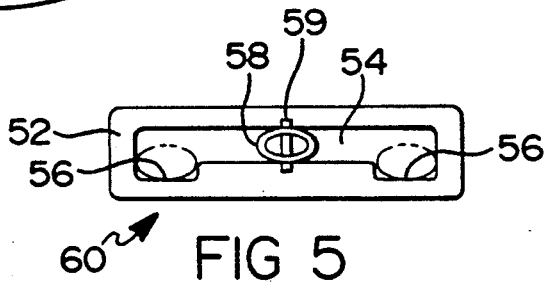
FIG. 5 is a front plan view of an alternative design of a supporting backplate of a shower enlarger assembly, for use with a straight shower rod.

In this alternative embodiment, FIG. 5 illustrates mounting bracket 60 which includes horizontally elongated supporting backplate 52 to be attached to a shower wall. Supporting backplate 52 has an elongated slot 54 located in its midsection for receiving an end of a straight shower curtain rod 58. Elongated slot 54 has two depressions 56, each projecting downward from the elongated portion of slot 54. Thus, elongated slot 54 is in the shape of a short inverted "U". Shower curtain rod 58, therefore, can rest in two positions (one at each depression 56) within elongated slot 54. One position toward the inside of the shower places the shower curtain further inside the shower area, and the other position, away from the shower area. Shower curtain rod 58 is held in place at either depression 56 of elongated slot 54 by gravity. The rod is restrained by pins which may be included at either end of the rod. The pins extend through the rod and are longer than the mounting bracket slot height. The pinned rods may be prevented from disengaging from the slotted mounting brackets by one of several means, such as fitting washers on the rod between the pins and the mounting brackets, or alternatively, slightly flattening the rod ends so that they are slightly shorter than the slot height, thus preventing the pins from rotating into a horizontal attitude.

Alternatively, elongated slot 54 may have a "V"-shape or any such shape so that the shower curtain rod can rest in two positions, one toward the inside of the shower area and the other away from the shower area.

Pin 59 is shown passing through curtain rod 58 and can serve as a means for retaining curtain rod 58 in slot 54 when the ends of pin 59 are inserted in indentations in bracket 52. Curtain rod 58 may be oblong in shape so that it does not rotate freely within slot 54.

While my invention has been described in terms of several specific embodiments, it must be appreciated that other embodiments could readily be adapted by one skilled in the art. Accordingly, the scope of my invention is to be limited only by the following claims.

I claim:

1. A convertible shower enlarger assembly for use in the showering area of a shower stall within a bathroom area, comprising:

a pair of mounting brackets for engaging respective ends of a bent shower curtain rod having an offset medial section for providing a greater stall space and for holding a shower curtain out of body contact each; said mounting bracket including a supporting backplate, said supporting backplate each receiving the respective ends of the bent shower curtain rod, said bent shower curtain rod is slidably and rotatably mounted therein;

said bent shower curtain rod including an integral rotating stop member on the respective ends of said curtain rod, the position of the rotating stop member relative to the supporting backplate changes as the curtain rod rotates; and a fixed stop member adjacent to said rotating stop member integral with each said mounting bracket and mounted so as to be, said rotating stop member contacting said fixed stop member as the bent shower curtain rod is rotated to restrain further travel of the rotating shower curtain rid, whereby the showering area of the shower stall is enlarged by rotating and stopping the bent shower curtain rod between a first, outwardly extending position to enlarge the shower area by said integral rotating stop member resting against the fixed stop member and rotating and stopping at a second inwardly extending position to enlarge the bathroom area.

2. The assembly of claim 1, wherein said fixed stop member is a one-piece semicircular protrusion extending from the supporting backplate.

3. A convertible shower enlarger assembly for use in the showering area intermediate opposing walls of a shower stall within a bathroom area comprising:

a mounting bracket for engaging to one of said opposing walls the ends of a bent shower curtain rod having an offset medial section for providing a greater shower stall space and for holding a shower curtain out of body contact;

said mounting bracket including a supporting backplate in fixed contact with said one opposing wall, said supporting backplate including a recessed area located at the midsection of said supporting backplate for receiving one of the ends of the bent shower curtain rod, said bend shower curtain rod slidably inserted and rotatably mounted within said recessed area of the supporting backplate;

said bent shower curtain rod including an integral rotating stop member at the end thereof and extending outwardly from the curtain rod, the position of the rotating stop member relative to the supporting backplate changing as the bent shower curtain rod rotates within the recessed area of the supporting backplate;

a fixed stop member integral with said supporting backplate and extending outwardly from the face of said backplate away from the wall and adjacent to and partially surrounding said recessed area, said rotating stop member contacts said fixed stop member as the bent shower curtain rod is rotated for restraining further travel of the rotating shower curtain rod, whereby the showering area of the shower stall is enlarged by rotating and stopping the bent shower curtain rod between a first outwardly extending position to enlarge the shower area by said integral rotating stop member resting against the fixed stop member and rotating and stopping at a second inwardly extending position to enlarge the bathroom area; and said fixed stop member being a one-piece semicircular protrusion located adjacent to the recessed area of the supporting backplate.

* * * * *